United States Patent [19]

Johnson

[11] 4,091,845

[45] May 30, 1978

[54] HANGER WIRE BENDER

[76] Inventor: Larry R. Johnson, 1501 Holland Ct., Independence, Mo. 64058

[21] Appl. No.: 785,340

[22] Filed: Apr. 7, 1977

[51] Int. Cl.[2] ..... B21F 1/00

[52] U.S. Cl. ..... 140/106; 72/217; 72/459

[58] Field of Search ..... 140/102.5, 106; 72/459, 72/321, 320, 218, 217

[56] References Cited

U.S. PATENT DOCUMENTS

| | | | |
|---|---|---|---|
| 2,722,858 | 11/1955 | Oyen | 72/217 |
| 2,732,744 | 1/1956 | Kuchman et al | 72/320 |
| 3,662,580 | 5/1972 | Power | 72/459 |

*Primary Examiner*—Lowell A. Larson

*Attorney, Agent, or Firm*—Fishburn, Gold & Litman

[57] ABSTRACT

A tool for bending metal wire hangers such as those used for hanging false ceilings below exposed under floor structures of the type separating successive floors in modern multiple story commercial buildings and in other buildings where a lowered ceiling is desired. The wire bending tool includes a pair of operating handles connected to a gripping jaw having members for holding a wire to be bent. The gripping jaw forms part of a rectangular block to which a third handle is pivotally mounted. The third handle is associated with a roller which cooperates with two corners of the block to bend the wire into two successive right angles as a third handle is pivoted about its axial connection on the rectangular block.

3 Claims, 7 Drawing Figures

HANGER WIRE BENDER

This invention relates to a novel wire forming device adapted to simultaneously grip and bend the free end of a hanging wire.

In building construction and renovation, elongated vertical wires with free ends are commonly used as hangers to support a frame for the installation of false ceilings. Such false ceilings are often suspended below the successive floor structures in modern multiple story commercial buildings to cover exposed utility and heating conduits. False ceilings may also be relied upon to lower high ceilings for aesthetic purposes in older buildings. Metal lathe for plastering operations or plasterboard may be secured to the frame to form the completed installation.

The frame used for hanging such false ceilings normally consists of a series of thin, elongated channel beams having a 1½ inch web and ½-inch flanges. The beams are posed on their flanged sides with webs vertically directed. Metal furring strips to which the plasterboard or metal lathe is secured are then wired to the channel beams. The upper end of the hanger wire is suitably anchored to the "true" ceiling and the lower end wrapped securely around one of the channel beams to suspend the beam from the ceiling. For installation, the wire must be bent in a precisely located U-shape with dual right angles, forming a holder in which the beam is subsequently positioned. The free end of the wire is then wrapped around the attached hanging wire, looped around the channel beam again then brought upwardly and twisted around the attached hanging wire thusly forming a distinctive tie known in the trade as a "saddle and a half".

There have long been problems in hanging the frame channels as it is most difficult for the workman to bend the wire at the correct height and in the correct formation so that the particular hanging wire may properly support its proportionate share of the load at a level attitude, as the "true" ceiling above may be sloping or otherwise have an uneven lower surface.

The U-shaped bend of the wire generally has been heretofore made by a craftsman using an ordinary pair of pliers. This method is unsatisfactory because not only is it physically difficult, as the wire may be quite sturdy, but also often requires a number of rebends in the same wire as the craftsman attempts to adjust the bend to precisely the correct spot and formation.

Various devices are known for bending tubing strap and wires as exemplified in U.S. Pat. Nos. 3,662,580, 3,604,244, and 1,316,257, however, none of these appear suitable to perform the above desired function.

The present invention has for its objects: to provide a wire bending tool that enables a hanging wire to be quickly and easily gripped preparatory to bending and easily released after it is bent; to provide a tool able to accommodate various wire diameters in the bending and gripping operation; to provide a wire bending tool with a pair of gripping handles pivotally movable with respect to each other and capable of being held by a workman in one hand; to provide a bending tool capable of bending said wire into two precisely located right angle cornered turns; forming a predetermined U-shaped bend; to provide a wire bending tool in which the bending operation may be performed by a workman using one hand while his other hand grips the wire gripping control handles; and to provide a wire bending tool capable of being easily carried and used by a workman, and which tool is economical to manufacture, sturdy in use, durable in construction, positive in operation and particularly well adapted for its proposed use.

Other objects and advantages of this invention will become apparent from the following description taken in connection with the accompanying drawings wherein are set forth, by way of illustration and example, a certain form of this invention.

The drawings constitute a part of the specification and include an exemplary embodiment of the present invention and illustrate various objects and features of the wire bending tool.

Figures 1, 2, 3:
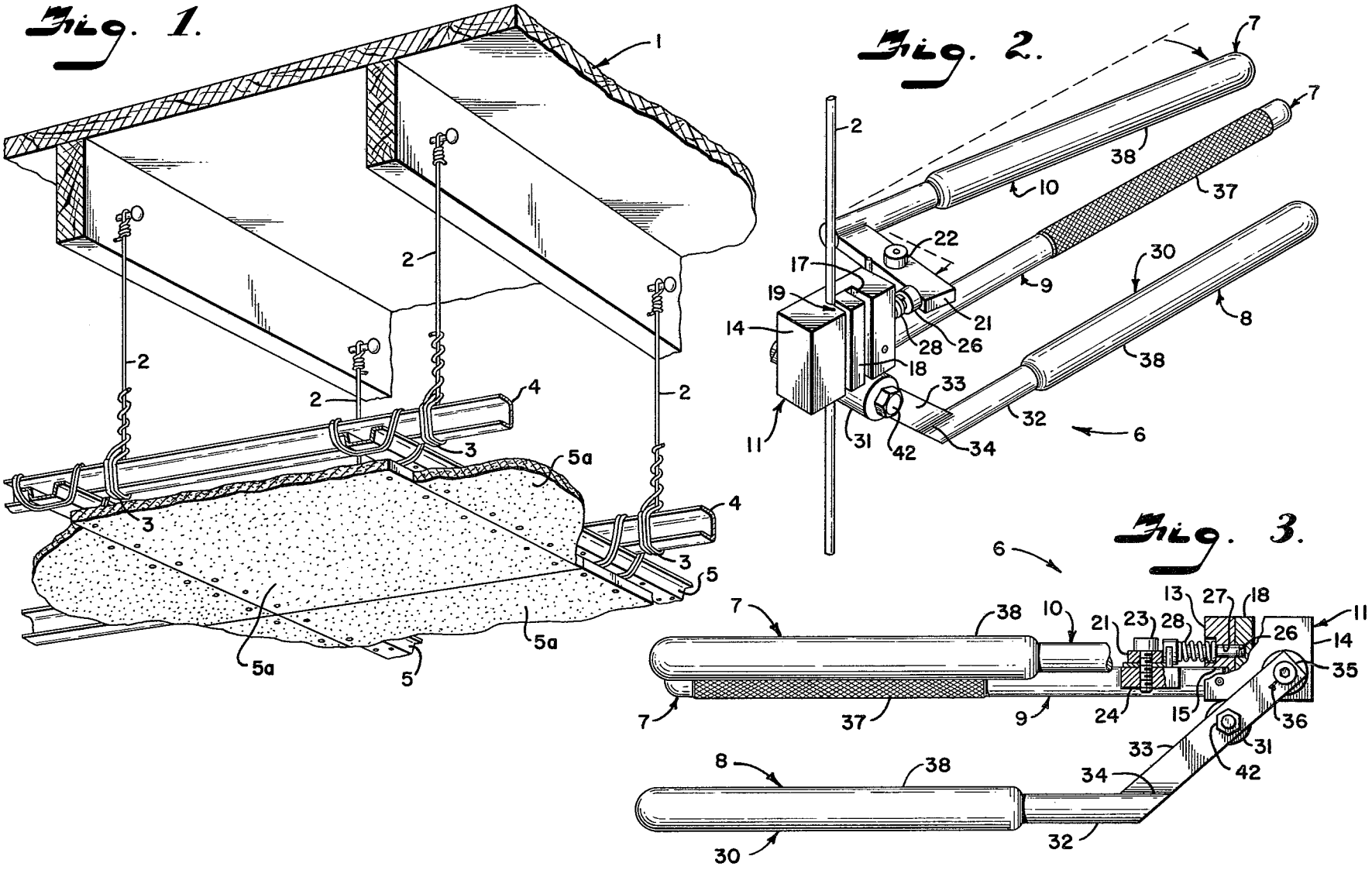
FIG. 1 is a broken perspective view of a typical floor structure and suspended ceiling showing a 4 foot by 4 foot grid of elongated metal wires suspending a ceiling frame.
FIG. 2 is a front perspective view of the wire bending tool.
FIG. 3 is a rear plan view of the wire bending tool.

As indicated hereinbefore wire bending tools of the type disclosed herein are useful in bending elongated metal wires to hang false ceilings. Illustrative wires of this type are shown in FIG. 1 in association with the underside of a typical floor structure 1 and suspended frame of channel beams 4 in which the floor structure may be of wooden sub-flooring and having horizontal portions and spaced joists with a large number of said wires fastened thereto. The wires 2 are secured to the joists in any suitable manner, as by being bent around a mounting nail.

It is to be noted that the practice of this invention is not limited to the use of round wire but includes oval and flattened wire as well as certain straps, all of which will be referred to generically herein as "wire". The round wire size is commonly #9 or #12 gauge but other sizes may be selected as conditions dictate.

The wires 2 project downwardly for a distance below the floor structure 1 and have free ends 3 to be bent at a precise point to levelly support the false ceiling frame including, in this example, a plurality of channel beams 4, although it is to be understood that other structural shapes such as angles, T-beams, and I-beams and the like may be used as desired. The beams may vary in size according to the load to be supported, the common type utilized in false ceiling construction having a 1½ inch vertically directed web and ½-inch horizontal flanges. The wire ends 3 are bent in a dual right angle U-shape into which is securely positioned the beam 4 by wrapping the free end 3 of the wire 2 around the beam 4 and twisting it about the remaining wire portion above the beam 4 as described above. The bottom interior portion of the "U" should be a predetermined slight dimension greater than the width of the flange, commonly slightly greater than ½ inch, to freely receive but securely hold the beam. Furring strips 5 to which plasterboard **5*a* may be affixed are then secured transversely to the beams 4**.

The wire bending tool is generally designated 6 and is preferably constructed of steel or other material suitable for metal fabricating purposes. A gripping portion 7 and a bending portion 8 form the major parts of the tool 6 with the bending portion associated with and using the gripping portion as a support and an anvil on which to turn and bend the wire 2. The gripping portion 7 is composed of a pair of elongated rod-shaped handles 9 and 10. Handle 9 is, in this example, a straight rod to which a rectangular block 11 is affixed at one end 12. The block 11 consists of a handle side portion 13 and an anvil side portion 14 with a lower handle side shaft opening 15 of sufficient diameter to permit fitting of the end 12 of handle 9 therein. The handle 9 is secured to the block 11 by a pin 16 extending transversely through the fitted portion of the block 11 and into the end 12 of the handle 9.

A transverse channel 17 extends across the longitudinal mid-portion of block 11, said channel 17 being milled to a depth sufficient to accommodate a wire 2 to be longitudinally positioned therein to subsequently be formed by operation of the tool. The handle side portion 13 of the channel 17 has longitudinally mounted therein a movable jaw member 18 consisting of an elongated bar operably connected by means to be disclosed hereinafter to a second gripping handle 10 thusly to form a gripping jaw 19 operating as a vise. That portion of block 11 forming the bottom portion of the channel 17 opposite the movable jaw member 18 is milled to form an arcuate groove 20. In operation, the free end 3 of the wire 2 is longitudinally positioned into the channel 17 wherein upon manually squeezing the handle 10 towards the opposing handle 9, the wire is gripped by the vise-like means formed by the cooperating side wall of the channel 17 and the jaw member 18, the groove 20 resistably retaining the wire 3 within the jaws.

Figures 4, 5, 6:
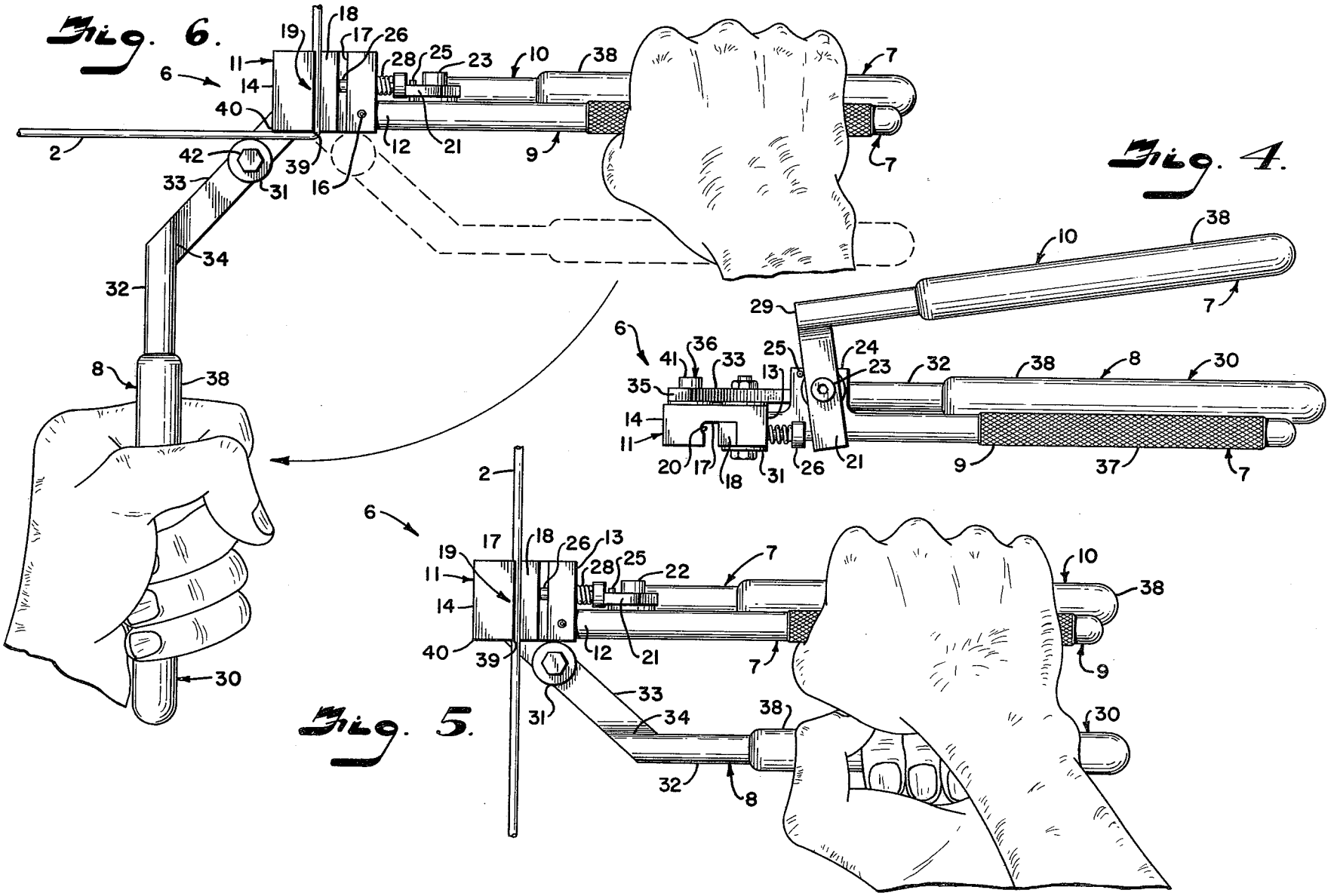
FIG. 4 is a top plan view of the wire bending tool.
FIG. 5 is a front elevational view of the wire bending tool gripping a wire to be bent with the handles being held by disembodied hands.
FIG. 6 is a front elevational view of the wire being bent in a first right angle in operational sequence with FIG. 5.

The jaw member 18 is operably directed by the second gripping handle 10 by means of a lever and fulcrum arrangement in this embodiment, although it is to be understood that other means may be used. The handle 10 is of lesser length than the handle 9 and so terminates short of the block 11, as best seen in FIG. 4. A lever 21 is affixed, as by welding, to the handle 10 at an end 29 at a right angle extending toward the block 11. Said lever 21 is mounted at its longitudinal mid-point to an axial connection generally designated as fulcrum 22 consisting of a bolt 23 extending through an opening in the lever 21 and a washer spacer secured into a mounting block 24 weldably connected to a side of the handle 9 opposite the channel 17 in the block 11. A stop pin 25 projects upwardly from the upper surface of the mounting block 24 to prevent excessive outward movement of the handle 10. When the gripping handles 9 and 10 are squeezed together, the lever 21 rotates about the fulcrum 22 to direct a pushing force to a reciprocable shaft 26 secured to the jaw member 18 through a bore 27 in the handle side portion 13 of block 11. The bore 27 extends through the handle side portion 13 and is aligned to the handle 9 and is vertically aligned to coordinate a pushing moment from lever 21. The shaft 26, with a threaded end portion, is mounted into a threaded receiving section of the jaw member 18. The shaft 26 extends through a coil spring 28 between the head of said shaft and the handle side portion 13 of the block 11. The coil spring 28, when compressed and force subsequently released, will return the gripping jaws to an open, receiving position.

The bending portion 8 of the tool is the wire forming portion and consists generally of the anvil portion 14 of the rectangular block 11 and an offset handle 30 with a roller 31 mounted thereto. As best illustrated in FIGS. 3 and 5, the offset handle 30 is comprised of a rod 32 with a bar 33 weldably affixed to an end 34 at a 45° angle to said end 34 permitting the rod 32 to be approximately parallel to handles 9 and 10 when the jaw 18 is in open position. The tool is then in its most compact position and is to be carried in such a manner by the workman. An end 35 of the bar 33 is pivotally mounted to the lower portion of the anvil side portion 14 of the rectangular block 11 by means of a bolt 41 extending through said bar, through a washer and into a threaded opening in that side opposite the channel 17, forming an axial connection 36. A roller 31 is perpendicularly mounted to the bar 33 on the side abutting the rectangular block 11 by a bolt and nut 42 extending through the roller 31 and the bar 33. The roller 31 is so located on the bar 33 to abut the rectangular block 11 when the handle 30 is in its ready position, that position being defined as when the jaw member is open to receive a wire to be bent.

The handles 9, 10, and 30 may have a knurled finish 37 or be fitted with slide-on grips 38 of rubber or plastic to aid in holding and operating the tool.

Figure 7:
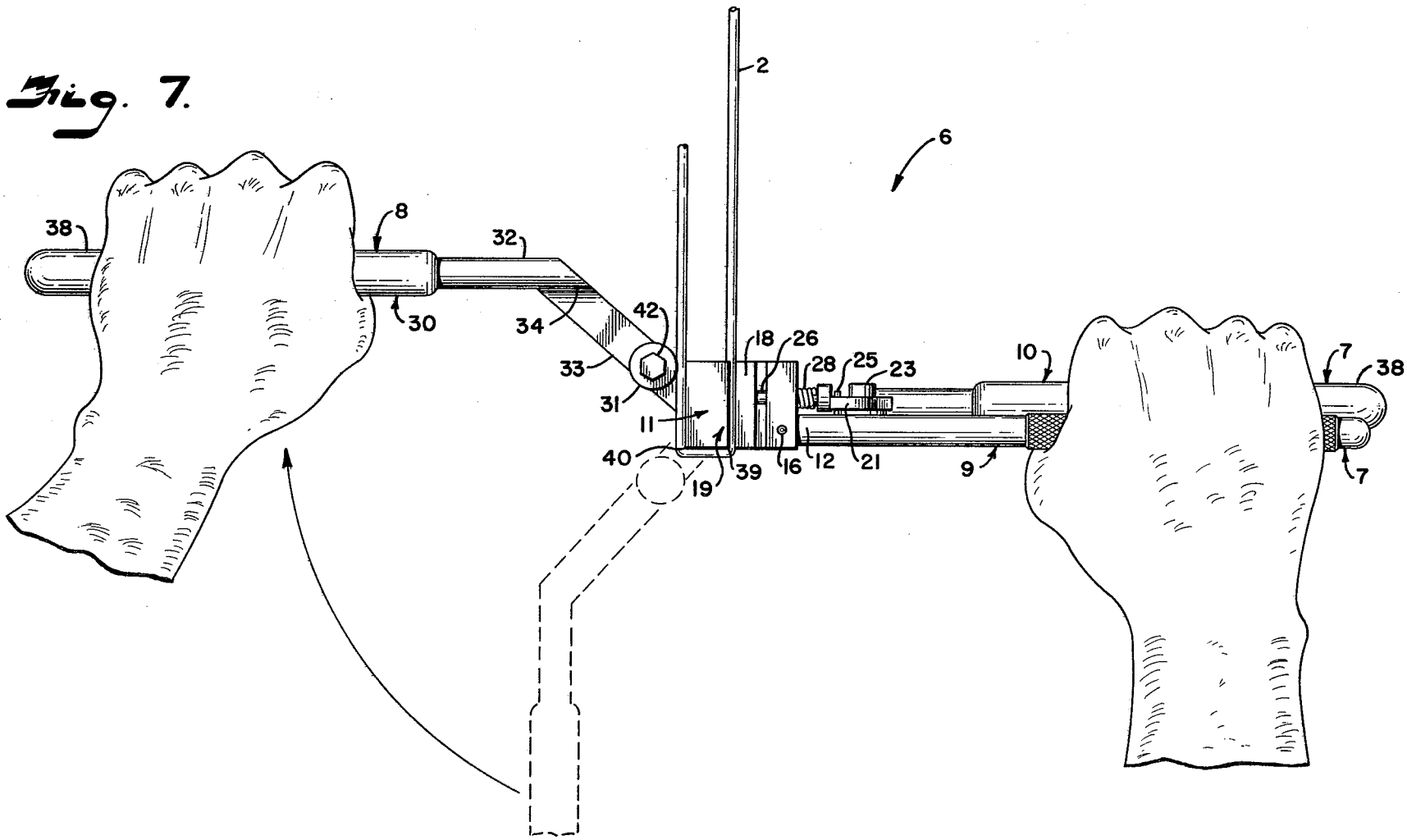
FIG. 7 is a front elevational view of the wire being bent in a second right angle in operational sequence with FIG. 6.

In use of the tool, as illustrated in FIGS. 5, 6 and 7, the free end 3 of a wire 2 is positioned longitudinally in the channel 17 and gripped by squeezing handles 9 and 10 together to force jaw member 18 against the wire. Handle 30 is pivotally rotated about its axial connection 36, bending the wire against the corner 39 of the gripping jaw 19 and then around to bend the wire a second time at the corner 40 of the anvil portion 14 of the rectangular block 11. Pressure is then released from handles 9 and 10 and the end of wire 3 is removed ready for receiving a channel beam 4.

It is to be understood that while I have illustrated and described one form of my invention, it is not to be limited to the specific form or arrangement of parts herein described and shown.

What I claim and desire to secure by Letters Patent is:

1. A bending tool for forming a wire hanger comprising:

(a) a pair of coordinating, pivotally mounted, elongated gripping handles operably connected to a jaw formed in a block member, said block member having an open channel extended therein and aligned normally to said handles, one of said handles being operably connected to an elongated bar positioned in said channel and reciprocably movable normal to said channel in response to movement of said handles to grip a wire to be formed;

(b) said block member having at least two right angle corners with a wire position locating flat facing portion extending therebetween, a first said corner being at an outlet portion of said channel and a second said corner being proximately located from said first corner and spaced therefrom by said facing portion; and (c) a third coordinating bending handle pivotally mounted on said block member by an axial connection means positioned on a line extending generally normally between said first and second corners, said bending handle having a wire contacting protuberance extended therefrom at a point proximately located and generally equidistant to said first and second corners when said bending handle is pivoted whereby a pair of precisely spaced right angle bends with a straight portion therebetween may be formed in a wire at a selected position determined by said facing portion.

2. A bending tool for forming a wire hanger as set forth in claim 1 wherein:

(a) said protuberance includes a roller means.

3. A hanger wire bending tool as in claim 1 wherein said rectangular block has a distance slightly greater than ½-inch between said corners.

* * * * *